US005380228A

United States Patent [19]

Kawai et al.

[11] Patent Number: 5,380,228

[45] Date of Patent: Jan. 10, 1995

[54] ABNORMAL CONDITION DISPLAYING SYSTEM OF AN ENGINE COOLING SYSTEM FOR OUTBOARD MOTOR

[75] Inventors: Takaji Kawai; Hitoshi Ishida, both of Hamamatsu, Japan

[73] Assignee: Sanshin Kogyo Kabushiki Kaisha, Hamamatsu, Japan

[21] Appl. No.: 208,918

[22] Filed: Mar. 8, 1994

Related U.S. Application Data

[63] Continuation of Ser. No. 985,584, Dec. 3, 1992, abandoned.

[30] Foreign Application Priority Data

Dec. 4, 1991 [JP] Japan ..... 3-348093

[51] Int. Cl.[6] ..... B63H 21/10

[52] U.S. Cl. ..... 440/88

[58] Field of Search ..... 440/88, 89, 53

[56] References Cited

U.S. PATENT DOCUMENTS

| | | | |
|---|---|---|---|
| 2,732,819 | 1/1956 | Irgens | 440/53 |
| 4,983,135 | 1/1991 | Boda et al. | 440/88 |
| 5,049,101 | 9/1991 | Binversie et al. | 440/88 |

FOREIGN PATENT DOCUMENTS

| | | |
|---|---|---|
| 4312889 | 6/1943 | Japan . |
| 5768120 | 10/1955 | Japan . |
| 63-17198 | 1/1988 | Japan . |
| 63-181597 | 11/1988 | Japan . |

*Primary Examiner*—Jesus D. Sotelo

*Attorney, Agent, or Firm*—Knobbe, Martens, Olson & Bear

[57] ABSTRACT

Two embodiments of water cooled outboard motors having a discharge spray that will provide an indication that coolant is flowing through the cooling jacket of the engine. The outboard motors may be swung through 180° for reverse operation and in the reversed position, the discharge spray is positioned in proximity to the transom of the watercraft. Devices are provided for disabling the discharge spray at operator selection.

2 Claims, 3 Drawing Sheets

ABNORMAL CONDITION DISPLAYING SYSTEM OF AN ENGINE COOLING SYSTEM FOR OUTBOARD MOTOR

This is application is a continuation of application Ser. No. 07/985,584, field Dec. 3, 1992 now abandoned.

BACKGROUND OF THE INVENTION

This invention relates to an abnormal condition displaying system of an engine cooling system for an outboard motor and more particularly to an improved display of this type.

Many types of outboard motors are provided with liquid cooled internal combustion engines. Due to the relative simplicity of an outboard motor, the engine does not have any significant number of gauges or indicators and hence, it is very rare that an outboard motor may have an engine temperature indicator gauge. As a result, the operator may not know if the water intake for the outboard motor becomes clogged and coolant is not delivered to the engine for its cooling or is delivered in a restricted manner so as to not adequately cool the engine. In order to provide a visual indication to the operator that coolant is flowing through the engine, it is a normal practice to provide a small bypass line in the water return from the engine cooling jacket to the body of water in which the watercraft is operating. This bypass line discharges the water rearwardly of the transom in a small amount so that the operator can always determine that coolant is flowing through the engine.

However, there is a type of outboard motor wherein the lower unit is not provided with a forward/neutral/-reverse transmission and wherein reverse operation is accomplished by pivoting the outboard motor through 180° about its steering axis. When this is done, however, the water bypass will fall either on the transom or inside of the hull, obviously undesirable results.

It is, therefore, a principal object of this invention to provide an improved abnormal condition display for an engine cooling system for an outboard motor wherein the aforenoted problems are avoided.

It is a further object of this invention to provide an abnormal display for an engine cooling system for an outboard motor wherein the operator can, upon selection, shut off the display for a variety of reasons including avoiding the spraying of water within the watercraft or upon himself.

SUMMARY OF THE INVENTION

This invention is adapted to be embodied in an outboard motor that is supported for steering movement about a generally vertically extending steering axis and which has a water cooled internal combustion engine in its power head for providing the propulsion power. Coolant is circulated through a cooling jacket of the engine and returned to the body of water in which the watercraft is operating. A bypass conduit extends from the water return to a point above the body of water in which the watercraft is operating and to the rear of the transom, in the normal condition, for discharging a small amount of coolant so that the operator can ascertain that the engine cooling system is operative. In accordance with the invention, means are provided for permitting the operator to selectively disable this discharge.

DETAILED DESCRIPTION OF THE PREFERRED EMBODIMENTS OF THE INVENTION

Figure 2:
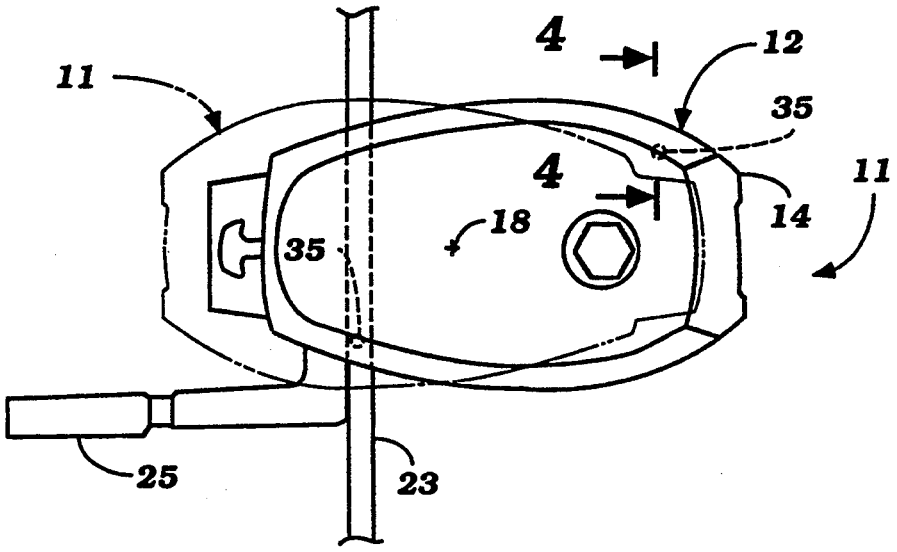
FIG. 2 is a top plan view thereof showing the motor in a forward mode in solid lines and in reverse mode in phantom lines.
Figure 1:
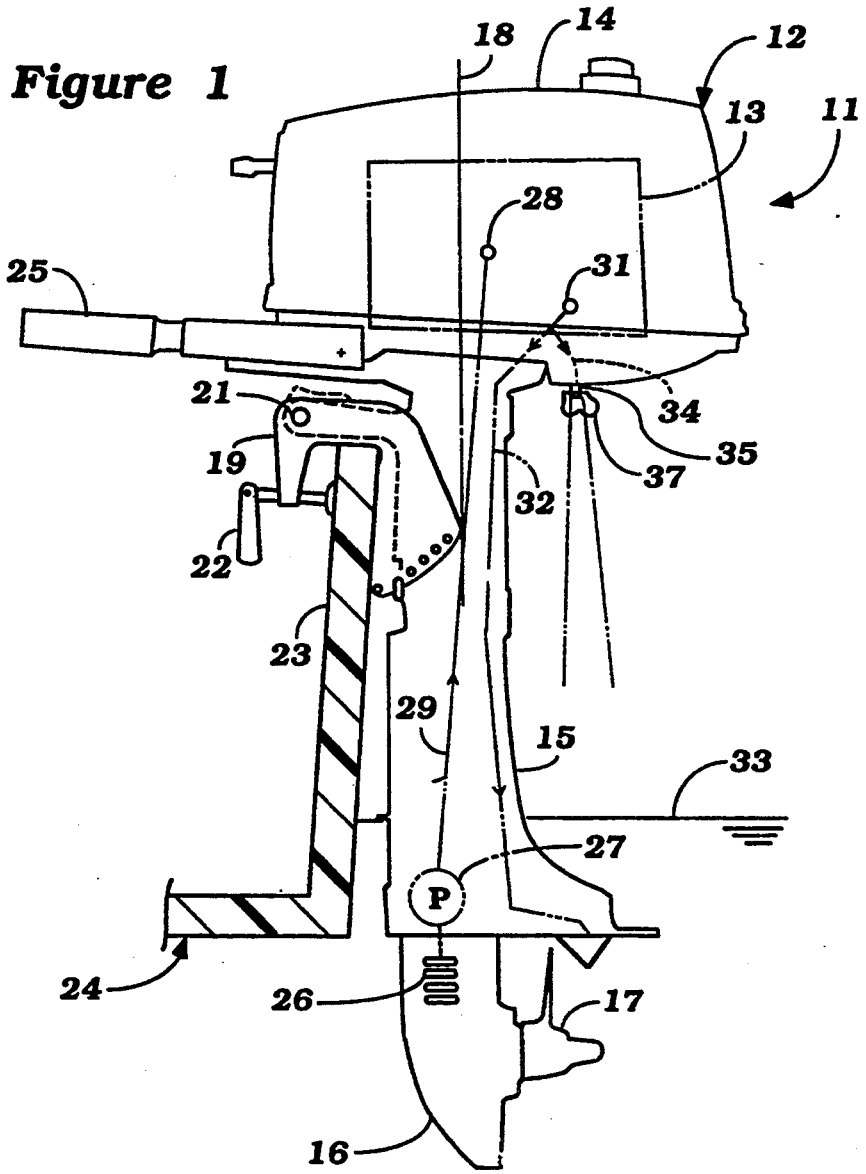
FIG. 1 is a side elevational view of an outboard motor constructed in accordance with an embodiment of the invention, as attached to the transom of a watercraft, shown partially and in cross section.
Figure 3:
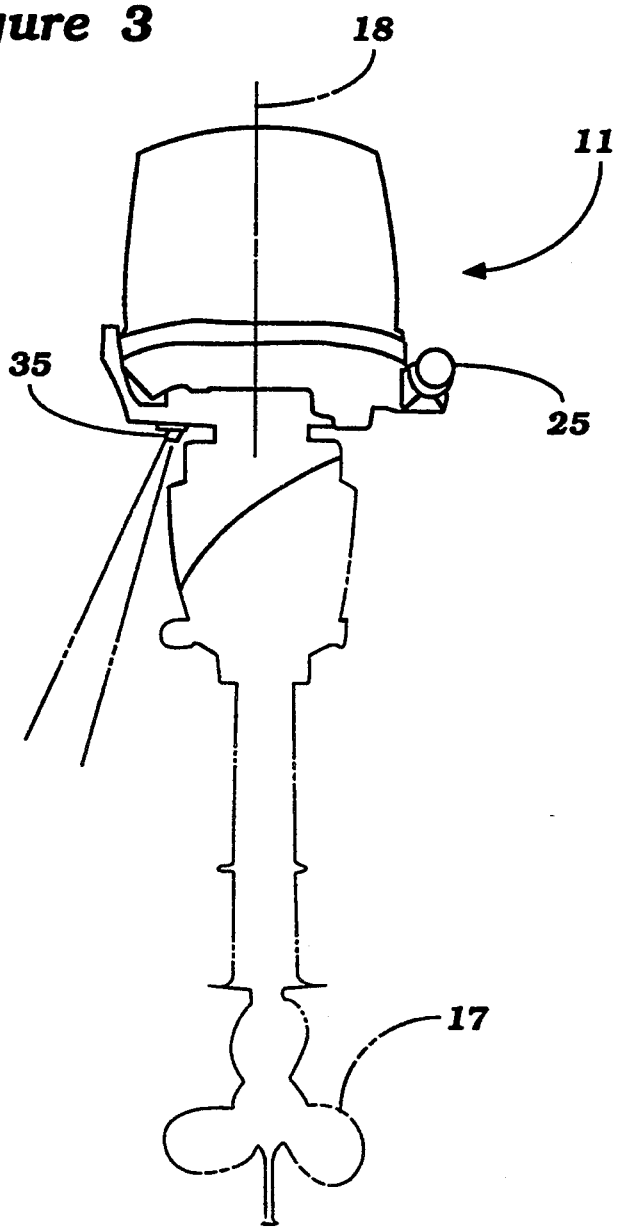
FIG. 3 is a front elevational view, with the watercraft removed and portions broken away and shown in phantom.
Figure 4:
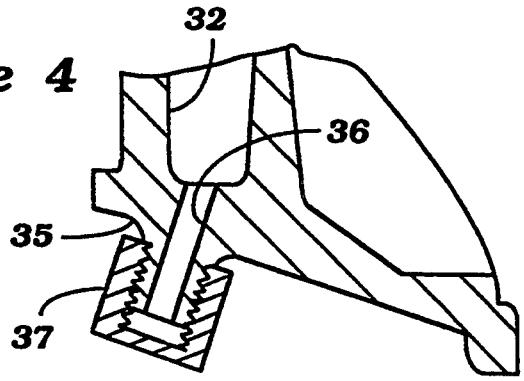
FIG. 4 is an enlarged cross-sectional view taken along the line 4—4 of FIG. 2.

Referring first to the embodiment of FIGS. 1–4, an outboard motor constructed in accordance with an embodiment of the invention is identified generally by the reference numeral 11. The outboard motor 11 includes a power head, indicated generally by the reference numeral 12, which includes a powering internal combustion engine, shown in block form and indicated at 13. The internal combustion engine 13 may be of any known type and is provided with a liquid cooling jacket for cooling the engine during its operation. A protective cowling 14 encircles the engine 13 and forms the remainder of the power head 12.

A driveshaft housing 15 depends from the power head 12 and contains a driveshaft (not shown) which depends into a lower unit 16 and drives a propeller 17 through a bevel gear transmission.

The outboard motor 11 is of the type wherein the lower unit 16 does not have a forward/neutral/reverse transmission and therefore, the driveshaft housing 15 is provided with an assemblage whereby it may be steered about a vertically extending steering axis 18 for steering between not only a forward position but also a reverse drive position, as shown in the phantom line view of FIG. 2 wherein the propeller 17 will deliver a reverse driving thrust to the associated watercraft.

The driveshaft housing 15 is connected to a clamping bracket 19 by means of a pivot pin 21 for tilt and trim operation. The clamping bracket 19 carries a clamping device 22 for affixing the outboard motor 11 to a transom 23 of an associated watercraft 24.

A tiller 25 is connected to the power head 12 and permits the aforenoted steering and reverse movement of the outboard motor 11. The construction of the outboard motor 11 as thus far described may be considered to be conventional and, as noted, the engine 13 may be of any water cooled type.

In conjunction with the water cooling for the engine 13 and as is typical with outboard motor practice, the lower unit 16 is provided with a water inlet opening 26 through which cooling water may be drawn from the body of water in which the watercraft is operating under the operation of a water pump 27 that is contained at the interface between the driveshaft housing 15 and the lower unit 16 and which is driven by the driveshaft in a known manner. The pump 27 delivers water to a water inlet opening 28 of the engine cooling jacket through a supply conduit 29. The engine cooling jacket also has a discharge opening 31 that communicates with a return passageway 32 that extends through the driveshaft housing 29 and discharges into the body of water in which the watercraft is operating below the normal water level, as shown by the line 33.

As is typical with this type of outboard motor, a small bypass line 34 extends from the return line 32 to a point in the lower surface of the power head 12 wherein a discharge fitting 35 is formed. The discharge fitting 35 has a passage 36 (FIG. 4) that communicates with the return conduit 32 and through which water is discharged at the rear of the power head 12 when the outboard motor 11 is being operated in a forward direction. As may be readily seen from FIG. 2, however, when the outboard motor 11 is pivoted to its reverse drive position, the discharge fitting 35 will be disposed above the transom 23 and may spray water back onto the operator.

In accordance with the invention, means are provided whereby the operator may disable the indicating spray for the fitting 35. A closure plug 37 may be selectively placed over the end of the discharge fitting 35 so as to preclude this spray when the operator wishes to operate the watercraft in reverse. If desired, this fitting 37 may be affixed by a chain, rope or the like to the power head 12 so that it will not be displaced or inadvertently lost.

Figure 5:
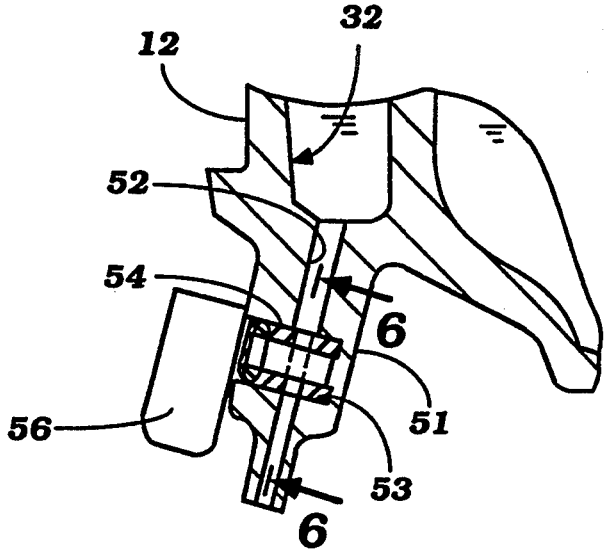
FIG. 5 is a cross-sectional view, in part similar to FIG. 4, and shows another embodiment of the invention.
Figure 6:
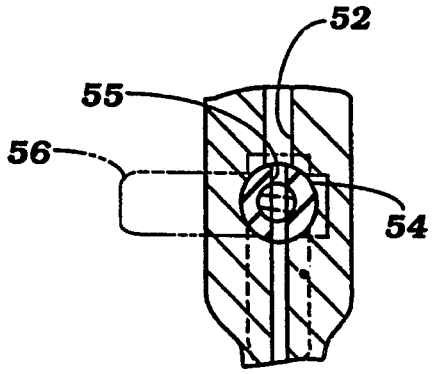
FIG. 6 is a cross-sectional view taken along the line 6—6 of FIG. 5.

FIGS. 5 and 6 show another embodiment of the invention which differs from the previously described embodiment only in the form of the water spray for indicating the abnormal condition and the way in which the indicator may be disabled. In this embodiment, a fitting 51 is formed on the power head 12 and has a passageway 52 that extends through it. The passageway 52 is intersected by a transversely extending passageway 53 in which a plug type valve 54 is positioned. The plug type valve 54, as is typical with this type of valve, has a cross passageway 55 which may be selectively positioned to permit flow through the discharge passage 52 to provide the indicating spray that the engine is receiving adequate coolant. However, the plug type valve 54 may be rotated to a closed position and cut off this spray so as to achieve the aforenoted result. A control lever 56 is formed on one end of the plug type valve 54 so as to permit this manipulation.

It should be readily apparent from the foregoing description that the described embodiments of the invention are very effective in providing an indication of an abnormal condition in the cooling system but which will also permit the abnormal condition display to be moved to a position for reverse operation without having the spray enter the watercraft. Of course, the foregoing description is that of preferred embodiments of the invention and various changes and modifications may be made without departing from the spirit and scope of the invention, as defined by the appended claims.

We claim:

1. An outboard motor comprised of a power head containing a water cooled internal combustion engine having a cooling jacket, means for circulating coolant from a body of water in which the watercraft is operating through said cooling jacket and returning said water to the body of water in which the watercraft is operating, a bypass conduit having a restricted discharge in a lower surface of said power head and above the water level and facing downwardly for providing an indication that coolant is being circulated through the engine, said outboard motor being supported for steering movement about a vertically extending steering axis and wherein said outboard motor may be rotated through 180° for reverse operation and in which position an outlet end of the bypass conduit will be in close proximity to the interior of the watercraft on which said outboard motor is mounted and a valve for completely disabling the flow through said discharge conduit, said valve comprising a rotatable valve element having a handle portion affixed to the end thereof and which handle portion has a greater length than the diameter of the valve element.

2. An outboard motor as set forth in claim 1, wherein a tiller is affixed to the outboard motor for effecting its steering motion on one side of a forward edge thereof and wherein the bypass conduit has its restricted discharge disposed on the rear end of the outboard motor and on the side opposite from the tiller.

* * * * *